US006466870B2

(12) United States Patent
Satonaka

(10) Patent No.: US 6,466,870 B2
(45) Date of Patent: Oct. 15, 2002

(54) SYSTEM AND METHOD FOR MAINTAINING A SKI SLOPE USING SNOWMAKING APPARATUSES

(75) Inventor: Toshihide Satonaka, Hiroshima (JP)

(73) Assignee: Kabushiki Kaisha Piste Snow Industries, Tokyo (JP)

( * ) Notice: Subject to any disclaimer, the term of this patent is extended or adjusted under 35 U.S.C. 154(b) by 0 days.

(21) Appl. No.: 09/790,756

(22) Filed: Feb. 22, 2001

(65) Prior Publication Data

US 2002/0116122 A1 Aug. 22, 2002

(51) Int. Cl.[7] ..... G01C 21/00
(52) U.S. Cl. ..... 701/213
(58) Field of Search ..... 701/213, 207; 239/2.2, 14.2

(56) References Cited

U.S. PATENT DOCUMENTS

| | | | | |
|---|---|---|---|---|
| 1,505,914 A | | 8/1924 | Witteborg | |
| 1,782,296 A | | 11/1930 | Goldstein | |
| 2,114,557 A | | 4/1938 | Davis | |
| 2,136,214 A | | 11/1938 | Keith | |
| 2,234,425 A | | 3/1941 | Brady | |
| 2,322,306 A | | 6/1943 | McLaren | |
| 2,609,992 A | | 9/1952 | Matthews | |
| 3,096,718 A | | 7/1963 | Anderson | |
| 3,250,530 A | | 5/1966 | Dean et al. | |
| 3,860,236 A | | 1/1975 | Buchanan | |
| 4,055,112 A | | 10/1977 | Larkfeldt | |
| 4,345,439 A | * | 8/1982 | Gundlach | 62/71 |
| 4,790,531 A | | 12/1988 | Matsui et al. | |
| 4,976,422 A | | 12/1990 | Shimamura | |
| 5,011,152 A | | 4/1991 | Hugunin | |
| 5,031,832 A | | 7/1991 | Ratnick et al. | |
| 5,230,218 A | | 7/1993 | Clulow | |
| 5,241,830 A | | 9/1993 | Morioka et al. | |
| 5,303,516 A | | 4/1994 | Delamare | |
| 5,327,738 A | | 7/1994 | Morioka et al. | |
| 5,331,991 A | | 7/1994 | Nilsson | |
| 5,482,510 A | | 1/1996 | Ishii et al. | |
| 6,079,161 A | | 6/2000 | Tomioka et al. | |

FOREIGN PATENT DOCUMENTS

| | | |
|---|---|---|
| JP | 62-270181 | 11/1987 |
| JP | 5-309158 | 12/1990 |
| JP | 5-135580 | 5/1992 |
| JP | 4-035664 | 6/1992 |
| JP | 6-051122 | 2/1994 |
| JP | 7-23964 | 9/1995 |
| JP | 11-22218 | 7/1997 |
| JP | 10-277199 | 10/1998 |
| JP | 11-319608 | 11/1999 |
| JP | 2996949 | 1/2000 |

* cited by examiner

*Primary Examiner*—Yonel Beaulieu
(74) *Attorney, Agent, or Firm*—Cummings & Lockwood

(57) ABSTRACT

A system and method for maintaining a desirable depth of snow on a ski slope, on which a plurality of snowmaking apparatuses are stationed to produce artificial snow. The system and method obtain the position of a snow compressing vehicle, and calculate the snow depth at the point by comparing the snow compressing vehicle's position against geographical information when there is no snow. The system and method evaluate the necessity for supplementing snow at the point, and output the necessary amount of snow for the point via the snowmaking apparatuses. Based on the need for supplementing snow at each point, the system further calculates an operating rate suitable for each snowmaking apparatus to achieve optimum efficiency.

20 Claims, 5 Drawing Sheets

SYSTEM AND METHOD FOR MAINTAINING A SKI SLOPE USING SNOWMAKING APPARATUSES

BACKGROUND OF THE INVENTION

1. Field of the Invention

This invention relates to a system and a method for maintaining a ski slope using snowmaking apparatuses.

2. Description of the Related Art

In general, it is necessary to evenly press down freshly fallen snow in order to maintain the ski slope. This is done by pressing down fresh snow and uniformizing the snow surface over a large area using a snow compressing vehicle.

When using the snowmaking apparatus, it is also required to spread and compress snow produced by snowmaking apparatus in a way similar to one described above. That is, when artificial snow is supplied by the snowmaking apparatus due to natural snow shortage, the produced artificial snow needs to be spread over a desired area or, especially, transported to areas where snow is scarce since the artificial snow is distributed unevenly on the ski slope.

Traditionally, whether or not the snowmaking apparatus should be operated is determined based on a human's visual check on snow coverage or on actual snow coverage measurement at selected points. Often, ski slope maintenance itself is performed by a snow compressing vehicle operator who maintains the snow surface while visually checking the snow condition.

However, this method produces inconsistent results depending on experiences and skills of each maintenance worker. Also in some cases, efficiency of ski slope maintenance may become compromised due to unnecessary operations of the snowmaking apparatus and the snow compressing vehicle.

SUMMARY OF THE INVENTION

A purpose of the present invention, created in consideration of the above circumstances, is to provide a system and a method which are capable of producing consistent results in the ski slope maintenance regardless of experiences and skills of ski slope maintenance workers.

A more specific purpose of the present invention is to provide a method and a system which enable efficient operation of a snowmaking apparatus and a snow compression machine.

To attain the above objectives, according to a first aspect of the present invention, there is provided a system for maintaining a ski slope with a plurality of snowmaking apparatuses, comprising: means for obtaining a geographical position of a snow compressing vehicle which is used for maintaining the ski slope; means for comparing said geographical position of the snow compressing vehicle and geographical information of a snowless ski slope to thereby calculate snow coverage at each position of the ski slope; means for determining snow supplement necessity based on the snow coverage at each position of the ski slope and outputting a required snow supplement amount in association with each position; and means for calculating a required operating rate for the snowmaking apparatus based on the required snow supplement amount for each portion of the ski slope.

According to a structure described above, it is possible to precisely measure the snow coverage at each position of the ski slope and operate each snowmaking apparatus at an optimum operating rate. Thus, it is possible to perform consistent and efficient maintenance of the ski slope.

According to one embodiment of the present invention, the aforesaid snow compressing vehicle position obtaining means obtains the snow compressing vehicle position through a GPS (Global Positioning System) which is installed on this snow compressing vehicle.

According to another embodiment, the aforesaid snow supplement necessity determination means calculates an average value of the snow coverage in a predetermined range and calculates the snow supplement necessity and the required snow supplement amount for each position of the ski slope based on the aforesaid average value.

According to still another embodiment, the aforesaid snowmaking apparatus operating rate calculation means sums the required snow supplement amount for positions which belong to a range covered by each snowmaking apparatus and calculates the required operating rate for each snowmaking apparatus.

According to yet another embodiment, the aforesaid snowmaking apparatus operating rate calculation means calculates the required operating rate for the aforesaid snowmaking apparatus in addition to the aforesaid required snow supplement amount based on a snow melting amount.

According to still another embodiment, the aforesaid snowmaking apparatus operating rate calculation means receives temperature, humidity and wind velocity data for positions where each snowmaking apparatus is installed and estimates the aforesaid snow melting amount based on the aforesaid temperature, humidity and wind velocity data.

According to yet another embodiment, the aforesaid snowmaking apparatus operating rate calculation means issues an operating command to each snowmaking apparatus based on a calculated operating rate.

According to still another one embodiment, this system further has means for issuing a snow compressing command to the aforesaid snow compression vehicle for each position of the ski slope based on the snow supplement necessity and the required snow supplement amount for each position of the ski slope.

According to a second aspect of the present invention, there is provided a method for maintaining the ski slope provided with a plurality of snowmaking apparatuses, comprising the steps of: obtaining the snow compressing vehicle position for the snow compressing vehicle used for maintaining the ski slope; comparing the snow compressing vehicle position, the snow compressing vehicle position obtained by snow compressing vehicle position obtaining means, and geographical information of the snowless ski slope to thereby calculate snow coverage at each position of the ski slope; determining the snow supplement necessity for each position of the ski slope and outputting the required snow supplement amount in association with each position; and calculating a required operating rate for the aforesaid snowmaking apparatus based on the required snow supplement amount, the aforesaid required snow supplement amount determined by snow supplement necessity determination means.

Other characteristics and marked effects of the present invention will become apparent to those skilled in the art upon referring to explanations of the following specification when taken in conjunction with the accompanying drawings explained below.

DETAILED DESCRIPTION OF THE PREFERRED EMBODIMENT

A preferred embodiment of the present invention will be described in detail below with reference to the accompanying drawings.

Figure 1:
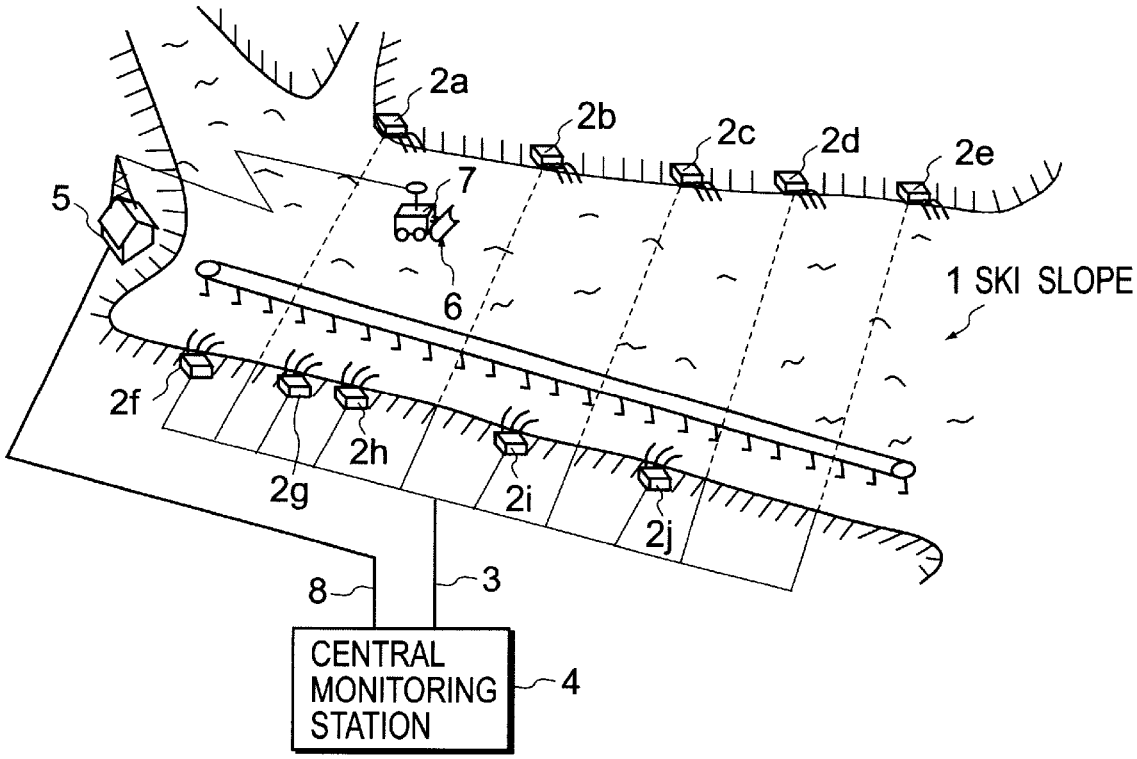
FIG. 1 is a schematic diagram showing an entire ski slope according to one embodiment of the present invention.

FIG. 1 is a schematic diagram showing an entire ski slope 1 of a ski resort A.

In this example of the ski resort A, ten snowmaking apparatuses 2*a*–2*j* are placed along the ski slope 1 with a predetermined interval. Here, each of these snowmaking apparatuses 2*a*–2*j* is an ice crushing system (hereafter, referred to as "ice crusher"), which produces snow by crushing ice flakes. All ice crushers 2*a*–2*j* are connected to a central monitoring station 4, with two-way communication through wiring 3, which is preferably made of optical cables.

At a place such as near an upper end of a ski lift, where it is convenient to look over the ski slope 1, there is installed a Global Positioning System (hereafter, referred to as "GPS") standard station 5, which is in radio communication with a snow compressing vehicle, shown as 6 in FIG. 1. This snow compressing vehicle 6 is equipped with a GPS moving station 7, which is capable of receiving radio waves from a GPS satellite and detecting its own three-dimensional position. A detected position of the GPS moving station 7 and, therefore, of the snow compressing vehicle 6 is transmitted to the GPS standard station 5 by radio and, then, to the central monitoring station 4 through wiring, shown as 8 in FIG. 1, which is preferably made of optical fibers.

Figure 2:
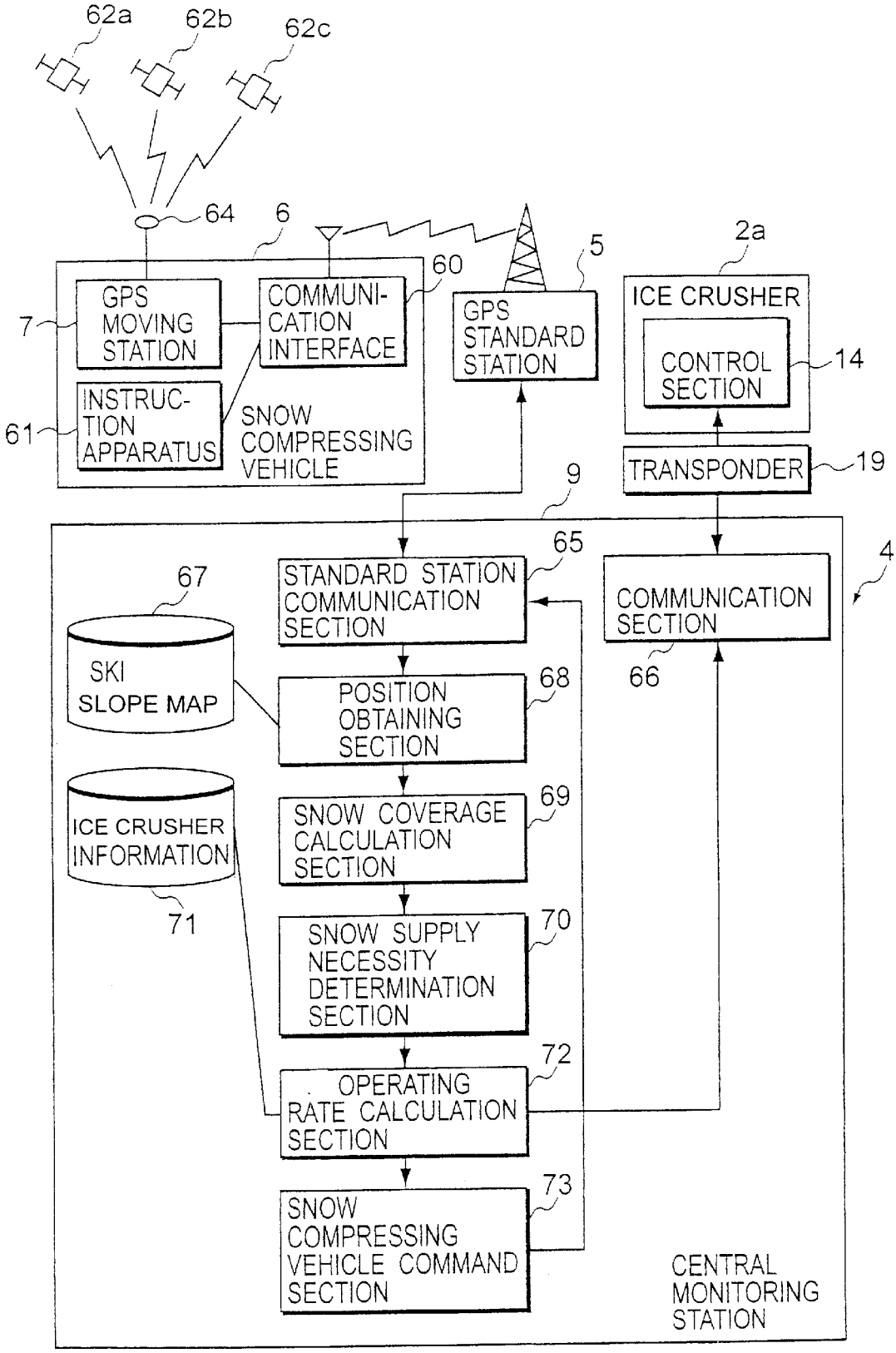
FIG. 2 is a schematic structural view showing a monitoring system provided at a central monitoring station of a skiing area.

FIG. 2 is a functional block diagram explaining details of the ice crusher 2*a* (for simplicity, ice crushers 2*b*–2*j* are not illustrated), the snow compressing vehicle 6, the GPS standard station 5 and a control system of a monitoring system 9, which is installed at the central monitoring station 4. Each of these components will be described in detail below in accordance with this FIG. 2 and other drawings.

Ice Crusher

First, the aforesaid ice crusher 2*a* has an ice crusher control section 14 for controlling the ice crusher 2*a*. This ice crusher control section 14 is connected to the monitoring system 9 through a predetermined transponder 19. An exemplary structure of the ice crusher 2*a* will be described below in accordance with FIG. 3.

Figure 3:
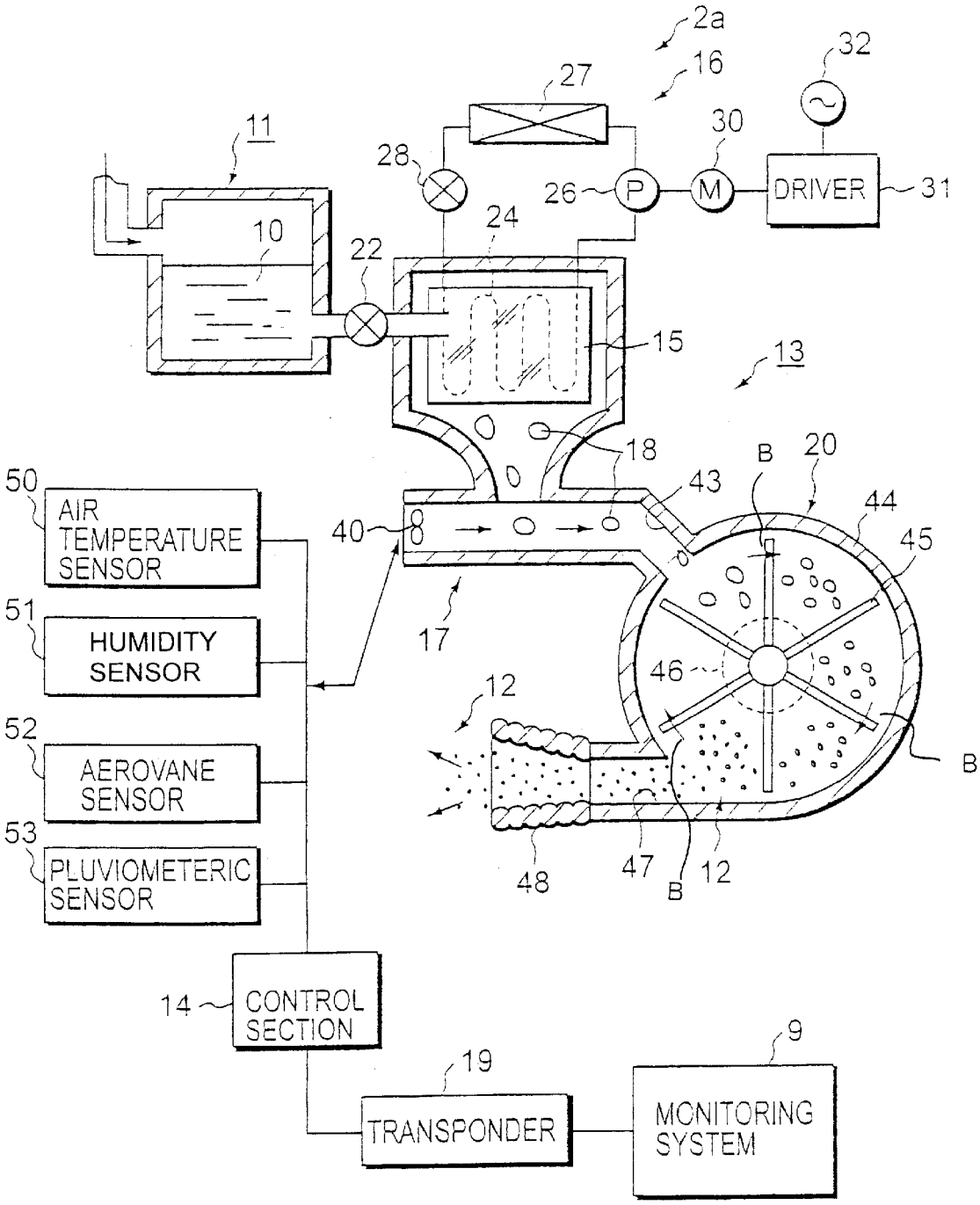
FIG. 3 is a schematic structural view showing a snowmaking apparatus.

As shown in FIG. 3, the ice crusher 2*a* is broadly defined by a water tank 11, which contains water 10 for snowmaking, and a snowmaking section 13 for generating and crushing ice flakes to thereby produce artificial snow 12.

This snowmaking section 13 has a cooling plate 15 for freezing the water 10, which is supplied from the aforesaid water tank 11, a cooling apparatus 16 for cooling the cooling plate 15, a blower 17, which is connected to the aforesaid cooling plate 15, for conveying ice flakes 18 produced by this cooling plate 15 at a predetermined air blast pressure, and a crushing machine 20, which is connected to one edge of the blower 17, for finely crushing the ice flakes 18 to thereby generate the artificial snow 12.

The aforesaid water tank 11 functions to filter and store the water 10 such as city water, rain water, snowmelt and the like, and supplying this water 10 to the cooling plate 15 while controlling the water flow using a flow control valve 22. The cooling plate 15 is, for example, drum-shaped and its surface is cooled to a temperature of, for example, −15 ° C. by the aforesaid cooling apparatus 16. Therefore, the water 10 supplied into this cooling plate 15 freezes and attaches on the surface of this cooling plate 15 as ice.

The aforesaid cooling apparatus 16 has a refrigerant pipe 24, which is fixed to the aforesaid cooling plate 15, and performs a heat exchange between a refrigerant, which is flowing in the refrigerant pipe 24, and the water 10 to thereby generate the ice flakes 18. The cooling apparatus 16 has a compressor 26 for compressing the refrigerant which passes through the cooling plate 15, a condenser 27 (heat exchanger) for condensing the refrigerant which passes through the compressor 26, and a expansion valve 28 for adiabatically expanding the refrigerant which passes through the condenser 27, and creates a cooling cycle to circulate the refrigerant in the above order.

Here, the aforesaid compressor 26 may be of any type such as a vortical type, a scroll type and the like, and is driven by, for example, a motor 30. This motor 30 is connected to a power source 32 through a driver 31.

The ice frozen on and attached to the aforesaid cooling plate 15 is scraped by a knife-shaped blade, an impeller vane or the like, or peeled off by hot gas with a temperature 70° C.–80° C. supplied through the cooling plate 15, and reshaped into the ice flakes 18 with a predetermined size. Next, these ice flakes 18 generated as above are sent into the aforesaid blower 17. This blower 17 has a function of sending the ice flakes 18 towards the aforesaid crushing machine 20 using the air blast pressure generated by an air blaster 40.

The crushing machine 20 has a casing 44, whose ice flake inlet 43 is connected to the aforesaid blower 17, crushing blades 45 installed in this casing 44 with a free rotation for crushing the ice flakes 18 to thereby produce the artificial snow 12. A rotational motor 46 drives the crushing blades 45 at a high speed rotation along arrows B. An artificial snow outlet 47 discharges the produced artificial snow 12 via a snow ejection pipe 48.

The ice flakes 18, which are sent to the crushing machine 20 by the blower 17, are crushed into small pieces by the crushing blades 45 rotating at a high speed and sent to the artificial snow outlet 47 as the artificial snow 12. Then, this artificial snow 12 is supplied onto the ski slope 1 through the snow ejection pipe 48, which is connected the artificial snow outlet 47.

Also, in order to detect ambient conditions, an air temperature sensor 50, a humidity sensor 51, an aerovane sensor 52 and a pluviometeric sensor 53 are installed on this ice crusher 2*a*.

These sensors 50–53 and drivers for the motor 30 and the rotational motor 46 are all connected to the aforesaid ice crusher control section 14. This ice crusher control section 14 controls each section to thereby produce the artificial snow 12 according to values detected by the sensors 50–53 and commands from external systems. According to this embodiment, commands for this ice crusher control section 14 are issued from the aforesaid monitoring system 9.

Snow Compressing Vehicle and GPS Standard Station

As shown in FIG. 2, the aforesaid snow compressing vehicle 6 has a communication interface 60 for communicating with the aforesaid GPS standard station 5. The communication interface 60 is connected to an instruction apparatus 61 for giving a driving instruction to a driver of the snow compressing vehicle 6, and to the aforesaid GPS moving station 7. The GPS moving station 7 has a function for receiving signals from at least three GPS satellites 62*a*–62*c* using a GPS elliptic antenna 64, which is installed at a predetermined position on the snow compressing vehicle 6, and calculating a position of this GPS elliptic antenna 64 based on the above signals.

Position data of the GPS elliptic antenna 64 is transmitted to the monitoring system 9 of the aforesaid central monitoring station 4 via the GPS standard station 5, and used for calculating snow coverage at each position on the ski slope 1 as described in detail below. Also, as described in detail below, the aforesaid monitoring system 9 issues a moving command to the snow compressing vehicle 6 according to the snow coverage at each position on the ski slope 1. The moving command is sent to the snow compressing vehicle 6 through the GPS standard station 5 and displayed at the aforesaid instruction apparatus 61.

Monitoring System

As shown in FIG. 2, the aforesaid monitoring system 9 has a standard station communication section 65 for communicating with the GPS standard station 5, an ice crusher communication section 66 for communicating with the ice crusher 2*a*, a ski slope map storage section 67 for storing geographical information of the ski slope 1 (ski slope map), a position obtaining section 68 for receiving the position data from the snow compressing vehicle 6 and obtaining the geographical information for the position on the ski slope 1, a snow coverage calculation section 69 for calculating the snow coverage at the position using the position data from the snow compressing vehicle 6 and the geographical information for the position, a snow supply necessity determination section 70 for determining snow supplement necessity for the position and outputting a required snow supplement amount in association with the position, an ice crusher information storage section 71 for storing a range covered by each of the ice crushers 2*a*–2*j*, an operating rate calculation section 72 for calculating an operating rate (required operation time) for each ice crusher based on the required snow supplement amount determined by the aforesaid snow supply necesity determination section 70 and the range covered by each of the ice crushers 2*a*–2*j*, and issuing an operating command to each ice crusher control section 14, and a snow compressing vehicle command section 73 for issuing a command to the snow compressing vehicle 6 in order to replenish snow to a position where snow supplement is required.

Each of the above components consists of computer software programs and operates when called and executed by a CPU (not illustrated) of the monitoring system 9 on RAM (not illustrated) of the monitoring system 9. Operation of each of the above components will be described below in an order of actual ski slope maintenance procedures.

Figure 4:
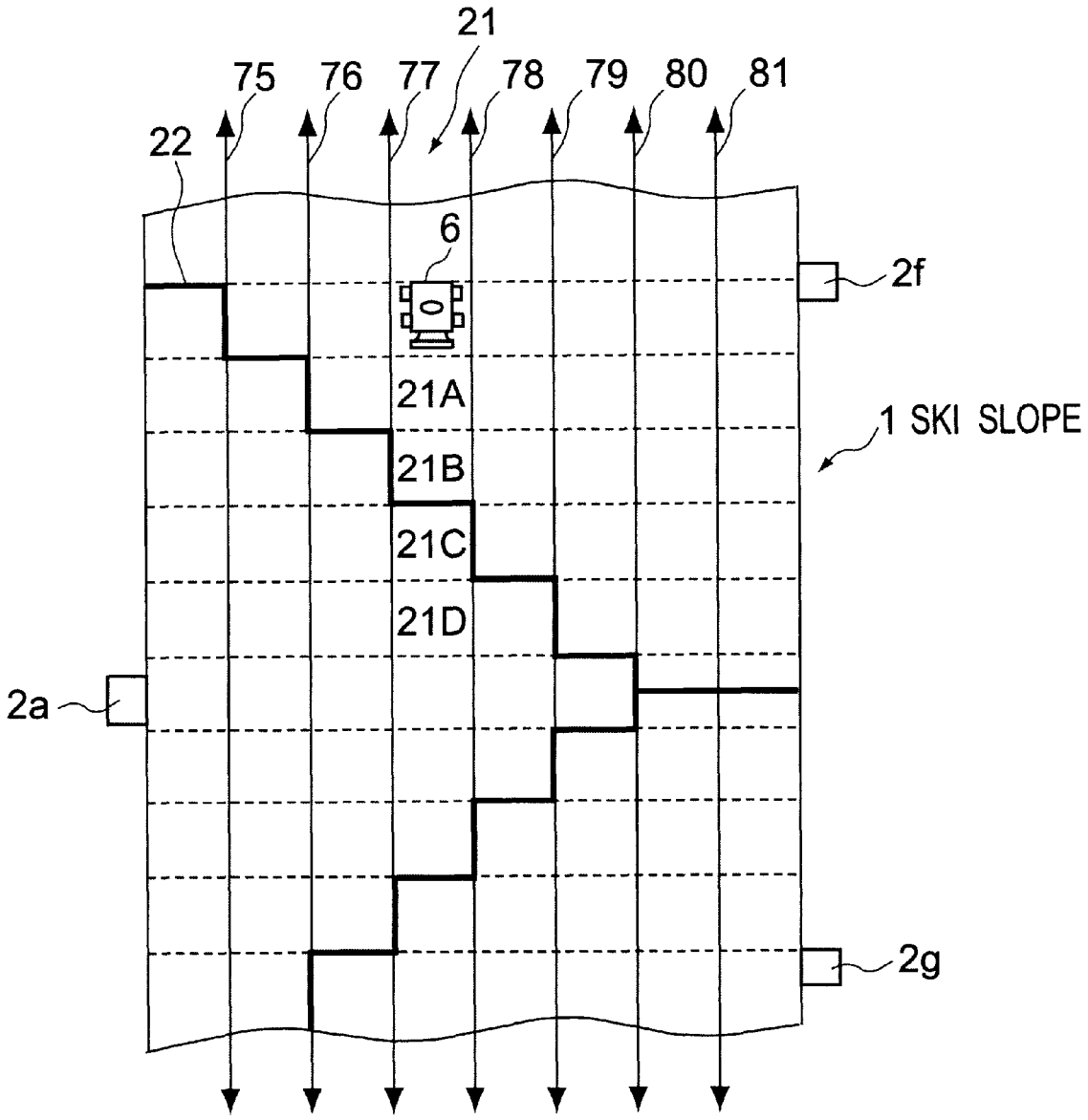
FIG. 4 is a schematic diagram showing a range of coverage for each ice crushing system for the entire ski slope.

FIG. 4 is a schematic diagram showing a relationship between the ski slope 1 and travelling lines of the snow compressing vehicle 6. The driver operates the snow compressing vehicle 6 so that the snow compressing vehicle 6 reciprocates on the ski slope 1 along the travelling lines, shown as 75–81 in FIG. 4, to thereby uniformly press down a surface of the ski slope 1. In this example, the snow compressing vehicle 6 moves along cells, shown as 21A, 21B, 21C, . . . in FIG. 4. As the snow compressing vehicle 6 moves along these cells, a position of the GPS elliptic antenna 64, which is installed on the snow compressing vehicle 6, is continuously detected and sent to the aforesaid monitoring system 9 via the aforesaid GPS standard station 5.

Next, the aforesaid position obtaining section 68 of the monitoring system 9 converts a coordinate of the GPS elliptic antenna 64 to another coordinate of a snow surface on which the snow compressing vehicle 6 travels (snow surface coordinate). Then, the position obtaining section 68 obtains a coordinate of a snowless ski slope surface, which corresponds to the snow surface coordinate, from the aforesaid ski slope map storage section 67.

Figure 5:
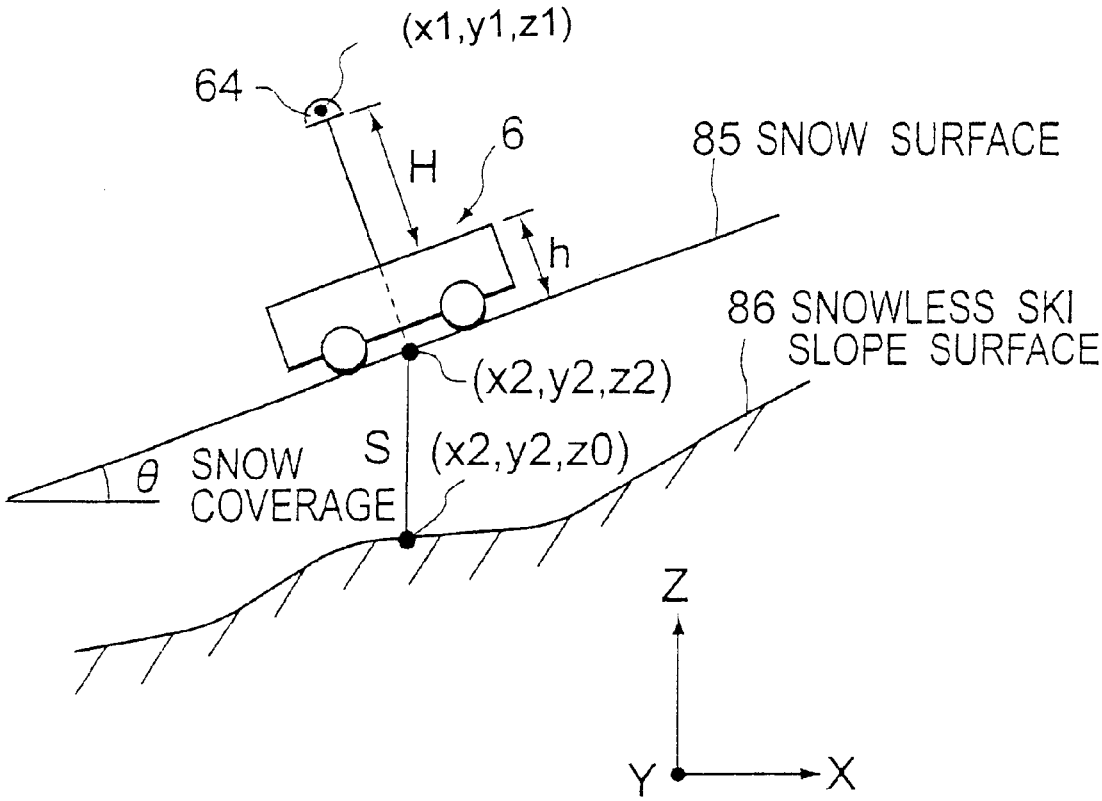
FIG. 5 is a schematic diagram showing a method for measuring snow coverage.

FIG. 5 is a schematic diagram explaining the above processing.

If a coordinate of the position of the GPS elliptic antenna 64 is ($X_1$, $Y_1$, $Z_1$), a coordinate on the snow surface 85, ($X_2$, $Y_2$, $Z_2$), is described as below. In FIG. 5, h is a height of the snow compressing vehicle 6, H is a height of the GPS elliptic antenna 64, θ (theta) is an inclination angle of a travelling direction of the snow compressing vehicle 6, and α (alpha) is an inclination angle of the ski slope width direction. Accordingly, the relationship between the positions is as follows:

$$X_2=X_1-(H+h)\text{Sin }\theta\times\text{Cos }\alpha$$

$$Y_2=Y_1-(H+h)\text{Sin }\theta\times\text{Sin }\alpha$$

$$Z_2=Z_1-(H+h)\text{Cos }\theta\times\text{Cos }\alpha$$

Then, the position obtaining section 68 obtains a coordinate of the snowless ski slope surface 86 ($X_2$, $Y_2$, $Z_0$), which has equal x- and y-coordinate values to x- and y-coordinate values of the snow surface coordinate, from the aforesaid ski slope map storage section 67.

Next, the aforesaid snow coverage calculation section 69 subtracts a z-coordinate of the snowless ski slope surface 86 from a z-coordinate of the snow surface 85 to thereby calculate the snow coverage (snow depth) S at the position of the snow compressing vehicle 6. In other words, in this case, the snow coverage S is derived as follows:

$$S=Z_2-Z_0=(H+h)\text{Cos }\alpha\times\text{Cos }\alpha-Z_0$$

In this example, the errors of measurement are 1.2 cm horizontally and 2.2 cm vertically if a distance between the GPS standard station 5 and the GPS moving station 7 is 1 km. Although these errors may increase marginally depending on a situation in actual cases, errors of about 5 cm are feasible if the distance between the GPS standard station 5 and the GPS moving station 7 is approximately 1 km.

Next, the calculated value of the snow coverage S is sent to the aforesaid snow supply necessity determination section 70, which calculates snow supplement necessity and a required snow supplement amount for, for example, each cell in FIG. 4 (21A, 21B, 21C, . . .) as snow compressing vehicle 6 passes thereover. Information on the required snow supplement amount for each cell is sent to the operating rate calculation section 72, shown in FIG. 2, and the operating rate for the corresponding ice crusher is determined as described below.

That is, first, the aforesaid cells are set to belong to a range covered by one of the ice crushers 2*a*–2*j*. For example, in the example of FIG. 4, the ice crusher 2*a* is set to cover a range of cells defined by a solid bold line 22. Therefore, the operating rate calculation section 72 summates required snow supplement amounts of all cells which belong to the range covered by the ice crusher 2*a* to thereby calculate the required snow supplement amount which the ice crusher 2*a* should supply. Next, this operating rate calculation section 72 receives the values detected by the sensors 50–53 of the ice crusher 2*a* and calculates a snow melting amount for the range covered by the ice crusher 2*a*. Then, based on the required snow supplement amount and the snow melting amount, the operating rate calculation section 72 calculates an optimal operating rate (required operation time) for the ice crusher 2*a* in order to maintain the range covered by the ice crusher 2*a* on the ski slope 1.

The operating rate calculation section 72 sets the operating rate for the ice crusher control section 14 of each of the ice crusher 2*a*–2*j* and operates each ice crusher based on a respective operating rate.

Concomitantly, the snow compressing vehicle command section 73 transmits information on the required snow supplement amount for each cell to the GPS moving station 7 through the GPS standard station 5. The information on the required snow supplement amount for each cell is displayed at the instruction apparatus 61 of the GPS moving station 7, for example, on a display panel. Thus, the driver of the snow compressing vehicle 6 can efficiently transport the artificial snow 12, which is produced by the aforesaid ice crushers 2*a*–2*j*, to thereby maintain the ski slope 1.

According to a structure described above, it is possible to provide a method and a system capable of producing consistent results in the ski slope maintenance regardless of experiences and skills of ski slope maintenance workers. Also, according to the structure described above, it is possible to efficiently operate the snowmaking apparatus and the snow compressing vehicle when maintaining the ski slope.

Incidentally, the present invention is not limited to the aforesaid one embodiment and various changes and modifications can be made, without departing from the scope and spirit of the present invention.

For example, although the aforesaid one embodiment uses the GPS for a purpose of detecting the position of the snow compressing vehicle, the present invention is not limited to using the GPS for that purpose. For example, it is possible to calculate the snow coverage by using a reflective effect of electric or sound waves on the ground surface, which are produced by the aforesaid snow compressing vehicle. Also, the aforesaid monitoring system 9 is not limited to be installed at the central monitoring station 4 provided on the ski resort A but may also be installed at a central monitoring station, which is remotely located from the ski resort A, for monitoring a plurality of ski slopes.

According to the aforesaid embodiment, by using the GPS standard station 5, data from the aforesaid snow compressing vehicle 6 is transmitted to the central monitoring station 4. However, the present invention is not limited to this embodiment. It is possible to transmit data to the central monitoring station 4 via a relay facility which is placed independently from the aforesaid standard station 5.

Furthermore, according to the aforesaid embodiment, the snow coverage S is calculated by referring to the inclination angle of the snow coverage position. However, the present invention is not limited to this embodiment. For example, there is provided a function for maintaining the angle of the aforesaid GPS elliptic antenna 64 vertical regardless of the inclination angle of the snow surface. With this function, it is possible to obtain the snow coverage amount on that position without referring to the angle of the snow surface.

While the invention has been described with respect to preferred embodiments, those skilled in the art will readily appreciate that various changes and/or modifications can be made to the invention without departing from the spirit or scope of the invention as defined by the appended claims.

What is claimed is:

1. A system for maintaining a ski slope provided with a plurality of snowmaking apparatuses, said system comprising:

first means for obtaining a geographical position of a snow compressing vehicle which is used for maintaining the ski slope;

second means for comparing said geographical position of the snow compressing vehicle and geographical information of a snowless ski slope to thereby calculate snow coverage at each position of the ski slope;

third means for determining snow supplement necessity based on said snow coverage at each position of the ski slope and outputting a required snow supplement amount in association with each position; and fourth means for calculating a required operating rate for at least one of the plurality of said snowmaking apparatuses based on said required snow supplement amount for each portion of the ski slope.

2. The system as set forth in claim 1, wherein said first means for obtaining the geographical position of the snow compressing vehicle obtains said geographical position of the snow compressing vehicle through a GPS (Global Positioning System), said GPS installed on the snow compressing vehicle.

3. The system as set forth in claim 1, wherein said third means for determining the necessity of the snow supplement calculates an average value of the snow coverage in a predetermined range and calculates the snow supplement necessity and the required snow supplement amount for each position of the ski slope based on said average value.

4. The system as set forth in claim 1, wherein said fourth means for calculating the required operating rate of at least one of the plurality of snowmaking apparatuses summates the required snow supplement amount for positions which belong to a range covered by each snowmaking apparatus and calculates the required operating rate for each snowmaking apparatus.

5. The system as set forth in claim 1, wherein said fourth means for calculating the operating rate of the snowmaking apparatus calculates the required operating rate for said snowmaking apparatus in addition to said required snow supplement amount based on a snow melting amount for positions which belong to a range covered by each snowmaking apparatus.

6. The system as set forth in claim 1, wherein said fourth means for calculating the operating rate of the snowmaking apparatus receives temperature, humidity and wind velocity data for positions where each snowmaking apparatus is installed and estimates said snow melting amount based on said temperature, humidity and wind velocity data.

7. The system as set forth in claim 1, wherein said fourth means for calculating the required operating rate of at least one of the plurality of snowmaking apparatuses issues an operating command to each of the plurality of snowmaking apparatuses based on the required operating rate.

8. The system as set forth in claim 1, further comprising:

fifth means for issuing a snow compressing command to said snow compression vehicle for each position of the ski slope based on the snow supplement necessity and the required snow supplement amount for each position of the ski slope.

9. A method for maintaining a ski slope provided with a plurality of snowmaking apparatuses, said method comprising the steps of:

obtaining a snow compressing vehicle position for the snow compressing vehicle used for maintaining the ski slope;

comparing the snow compressing vehicle position, said snow compressing vehicle position obtained by said snow compressing vehicle position obtaining means, and geographical information of a snowless ski slope to thereby calculate snow coverage at each position of the ski slope;

determining the snow supplement necessity for each position of the ski slope and outputting the required snow supplement amount in association with each position; and calculating a required operating rate for at least one of said plurality of snowmaking apparatuses based on the required snow supplement amount, said required snow supplement amount determined by said snow supplement necessity determination means.

10. The method as set forth in claim 9, wherein said step of obtaining the snow compressing vehicle position obtains the snow compressing vehicle position through the GPS, said GPS installed on this snow compressing vehicle.

11. The method as set forth in claim 9, wherein said step of determining the snow supplement necessity for each position of the ski slope and outputting the required snow supplement amount in association with each position calculates an average value of the snow coverage in a predetermined range and calculates the snow supplement necessity and the required snow supplement amount for each position of the ski slope based on said average value.

12. The method as set forth in claim 9, wherein said step of calculating a required operating rate for at least one of said plurality of snowmaking apparatuses based on the required snow supplement amount, said required snow supplement amount determined by said snow supplement necessity determination means, summates the required snow supplement amount for positions which belong to a range covered by each snowmaking apparatus and calculates an required operating rate for each snowmaking apparatus based on said required snow supplement amount.

13. The method as set forth in claim 9, wherein said step of calculating a required operating rate for said snowmaking apparatus based on the required snow supplement amount, said required snow supplement amount determined by said snow supplement necessity determination means, calculates the required operating rate for the snowmaking apparatus in addition to said required snow supplement amount based on a snow melting amount for positions which belong to a range covered by each snowmaking apparatus.

14. The method as set forth in claim 9, wherein said step of calculating a required operating rate for said snowmaking apparatus based on the required snow supplement amount, said required snow supplement amount determined by said snow supplement necessity determination means, receives temperature, humidity and wind velocity data for positions where each snowmaking apparatus is installed and estimates said snow melting amount based on said temperature, humidity and wind velocity data.

15. The method as set forth in claim 9, wherein said step of calculating a required operating rate for said snowmaking apparatus based on the required snow supplement amount, said required snow supplement amount determined by said snow supplement necessity determination means, issues an operating command to each snowmaking apparatus based on a calculated operating rate.

16. The method as set forth in claim 9, further comprising the step of:

issuing a snow compressing command to said snow compression vehicle for each position of the ski slope based on the snow supplement necessity and the required snow supplement amount for each position of the ski slope.

17. The system as set forth in claim 1, wherein the second means is a snow coverage calculation section.

18. The system as set forth in claim 1, wherein the second, third and fourth means are part of a central monitoring station.

19. A system for efficiently maintaining a ski slope comprising:

a vehicle for moving snow on the ski slope;

a control station for determining a snow depth on the ski slope; and a vehicle location system operatively connected to the vehicle and the control station for ascertaining a position of the vehicle to determine the snow depth, wherein the control station provides instructions to an operator of the vehicle as to how to transport snow based upon the snow depth.

20. The system as set forth in claim 1, further comprising snowmaking apparatus on the ski slope, wherein each snowmaking apparatus has an area of the ski slope associated therewith and the control station varies the output of each of the snowmaking apparatus based upon the snow depth within the area associated therewith.

* * * * *